US008144911B2

(12) United States Patent
Chiang et al.

(10) Patent No.: US 8,144,911 B2
(45) Date of Patent: Mar. 27, 2012

(54) GARMENT WITH SPEAKER FUNCTION

(75) Inventors: Dar-Ming Chiang, Hsinchu (TW); Jen-Yuh Jiang, Taipei County (TW)

(73) Assignee: Industrial Technology Research Institute, Hsinchu (TW)

( * ) Notice: Subject to any disclaimer, the term of this patent is extended or adjusted under 35 U.S.C. 154(b) by 1028 days.

(21) Appl. No.: 12/061,659

(22) Filed: Apr. 3, 2008

(65) Prior Publication Data

US 2009/0161899 A1 Jun. 25, 2009

(30) Foreign Application Priority Data

Dec. 21, 2007 (TW) ..... 96149289 A

(51) Int. Cl.

| | |
|---|---|
| ***H04R 9/06*** | (2006.01) |
| ***H04R 1/02*** | (2006.01) |
| ***H04R 9/08*** | (2006.01) |
| ***H04R 25/00*** | (2006.01) |

(52) U.S. Cl. ..... 381/333; 381/354; 381/364; 381/172; 381/388; 381/191

(58) Field of Classification Search ..... 381/333, 381/354, 163, 364, 368, 172, 388, 191, 428, 381/158, 301, 28

See application file for complete search history.

(56) References Cited

U.S. PATENT DOCUMENTS

| | | | | |
|---|---|---|---|---|
| 4,539,700 | A * | 9/1985 | Sato | 381/333 |
| 4,589,134 | A | 5/1986 | Waldron | |
| 4,825,471 | A * | 5/1989 | Jennings | 2/94 |
| 4,876,724 | A * | 10/1989 | Suzuki | 381/385 |
| 5,682,434 | A | 10/1997 | Boyden | |
| 5,687,245 | A | 11/1997 | Boyden | |
| 6,023,516 | A * | 2/2000 | Rifkind | 381/301 |
| 6,097,882 | A * | 8/2000 | Mogul | 709/201 |
| 6,818,816 | B2 * | 11/2004 | Roberts et al. | 84/723 |
| 6,819,771 | B2 * | 11/2004 | Menzies | 381/333 |
| 7,035,422 | B1 | 4/2006 | Wiener | |
| 7,043,028 | B2 * | 5/2006 | Leske et al. | 381/59 |
| 7,251,332 | B2 * | 7/2007 | Eves | 381/11 |
| 7,769,412 | B1 * | 8/2010 | Gailloux | 455/569.1 |
| 2002/0197960 | A1 | 12/2002 | Lee et al. | |
| 2004/0114777 | A1 * | 6/2004 | Aubauer et al. | 381/333 |

(Continued)

FOREIGN PATENT DOCUMENTS

| | | |
|---|---|---|
| JP | 2000-139537 | 5/2000 |

(Continued)

OTHER PUBLICATIONS

"Notice of Allowance of Taiwan Counterpart Application", issued on Feb. 9, 2011, p. 1-p. 4, in which the listed references were cited.

*Primary Examiner* — Anh Mai
*Assistant Examiner* — Mangtin Lian
(74) *Attorney, Agent, or Firm* — Jianq Chyun IP Office

(57) ABSTRACT

A garment with a speaker function is provided. The garment includes a garment body, a bag, and an electret speaker. The bag disposed on the garment body includes a sound-absorbing layer. The electret speaker, disposed in the bag, gives off sounds to a first direction and a second direction at the same time. The sound-absorbing layer absorbs the sound of the second direction. Therefore, the present invention not only provides convenience to the user, but also enhances the acoustic quality of the electret speaker.

15 Claims, 5 Drawing Sheets

U.S. PATENT DOCUMENTS

| | | | | |
|---|---|---|---|---|
| 2005/0254674 | A1* | 11/2005 | Huang et al. | 381/190 |
| 2006/0251284 | A1* | 11/2006 | Wiener | 381/388 |
| 2007/0081690 | A1* | 4/2007 | Stagni et al. | 381/384 |
| 2008/0271220 | A1* | 11/2008 | Chilton et al. | 2/69 |
| 2009/0100570 | A1* | 4/2009 | Tuan | 2/122 |

FOREIGN PATENT DOCUMENTS

| | | |
|---|---|---|
| JP | 2002-294536 | 10/2002 |
| TW | 456192 | 9/2001 |
| TW | I226161 | 1/2005 |
| WO | 97-39464 | 10/1997 |

* cited by examiner

GARMENT WITH SPEAKER FUNCTION

CROSS-REFERENCE TO RELATED APPLICATION

This application claims the priority benefit of Taiwan application serial no. 96149289, filed on Dec. 21, 2007. The entirety the above-mentioned patent application is hereby incorporated by reference herein and made a part of specification.

BACKGROUND OF THE INVENTION

1. Field of the Invention

The present invention generally relates to a garment, in particular, to a garment with a speaker function.

2. Description of Related Art

Public announcing loudspeaker system is commonly used in daily life. In schools, construction sites, military camps, and other large-scale sites, the public announcing loudspeaker systems are essentially used to deliver messages; or tourist guides, narrators, and teachers often use public announcing loudspeaker systems.

As the rapid development of the technology, the public has expected the electronic devices to become increasingly light, thin, short, and small, so does the public announcing loudspeaker system commonly used in daily life. Generally, the public announcing loudspeaker system includes a sound receiver, an amplifying circuit, and a speaker. Therefore, the volume and weight of the speaker device can only be reduced to a quite limited extent. Therefore, currently, the portable loudspeakers (also called little honeybee) and handheld loudspeakers (also called megaphone or megahorn) are most commonly used.

Although the portable loudspeakers and megaphones have been most widely accepted and used, they have their own inconveniences. As for the megaphone, although it has portability, it does not have a small weight, so it is inconvenient for being used for a long time, and its functionality is poorer than that of the portable loudspeaker. As for the portable loudspeaker, although it has a small weight and it is more suitable for being taken along than the megaphone, it is only suitable for being used under a static state. When the user is moving or running, it may be thrown out by accident, and thus losing the speaker function.

SUMMARY OF THE INVENTION

Accordingly, the present invention is directed to a garment with a speaker function, which not only improves the convenience of the public announcing loudspeaker system, but also enhances the acoustic quality of the speaker.

The present invention provides a garment with a speaker function, which includes a garment body, a bag, and an electret speaker. The bag includes a sound-absorbing layer. The bag is disposed on the garment body. The electret speaker is disposed in the bag, and gives off sound to a first direction and a second direction at the same time. The sound-absorbing layer is used to absorb the sound of the second direction.

In the present invention, the electret speaker is disposed on the garment, and the sound-absorbing layer is used to absorb the sound of a specific direction, thereby enhancing the acoustic quality. Therefore, the present invention not only solves the convenience problem in the conventional art, but also enhances the acoustic quality of the electret speaker.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF THE EMBODIMENTS

Figure 1:
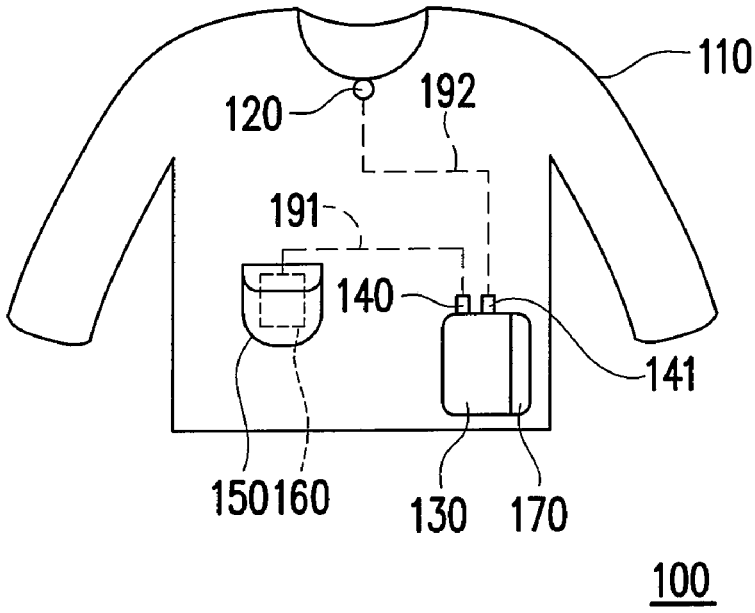
FIG. 1 is a structural view of a garment with a speaker function according to an embodiment of the present invention.

Reference will now be made in detail to the present embodiments of the invention, examples of which are illustrated in the accompanying drawings. Wherever possible, the same reference numbers are used in the drawings and the description to refer to the same or like parts.

FIG. 1 is a structural view of a garment with a speaker function according to an embodiment of the present invention. In FIG. 1, a garment 100 with a speaker function includes a garment body 110, a sound receiver 120, an amplifying unit 130, connectors 140 and 141, a bag 150, an electret speaker 160, a power supply 170, and soft wires 191 and 192. In this embodiment, the sound receiver 120, the amplifying unit 130, the connectors 140 and 141, the bag 150, and the power supply 170 are all disposed on an external surface of the garment body 110, and the electret speaker 160 is disposed in the bag 150. The persons who implement the present invention may determine the positions of the sound receiver 120, the amplifying unit 130, the connectors 140 and 141, the bag 150, and the power supply 170, depending upon the actual requirements. For example, the bag 150 is disposed on an internal surface of the garment body 110, so as to form an inside pocket.

Referring to FIG. 1, the sound receiver 120 (e.g., microphone) is electrically connected to the amplifying unit 130 through the soft wire 192 and the connector 141. The electret speaker 160 is electrically connected to the connector 140 through the soft wire 191, and the connector 140 is electrically connected to the amplifying unit 130. The power supply 170 is electrically connected to the amplifying unit 130 through a soft wire (not shown).

Figure 2:
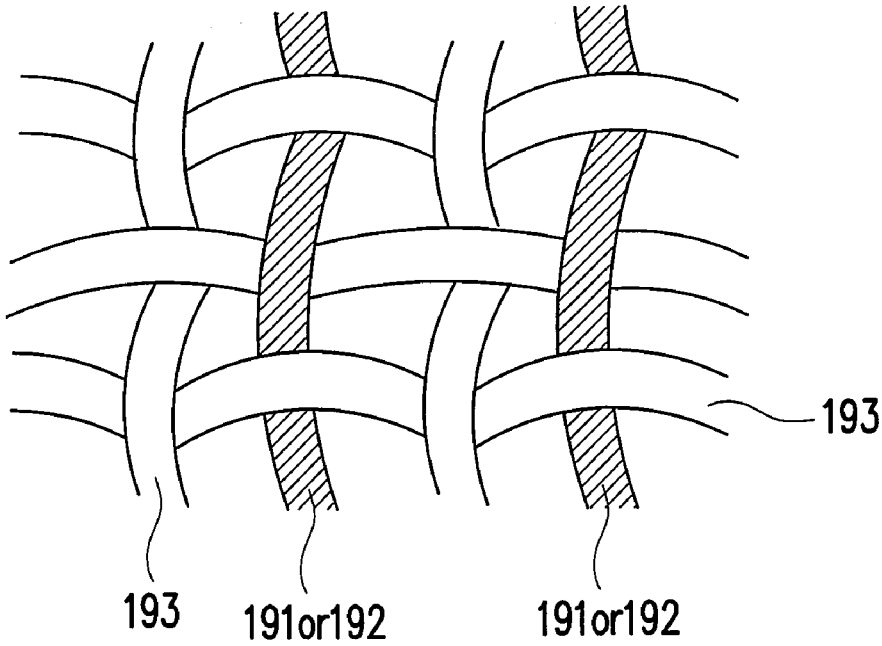
FIG. 2 is a partial schematic view of a garment body with a plurality of wires in FIG. 1 knitted therein.

In FIG. 1, the soft wires 191 and 192 are indicated by dash lines, and the wiring manner of the soft wires 191 and 192 in FIG. 1 is only one implementing manner, which is not limited here. In this embodiment, the soft wires 191 and 192 are knitted in a fabric 193 of the garment body 110, as shown in FIG. 2. Therefore, as for the garment 100 with the speaker function in the embodiment of the present invention, the wire winding or exposing situation does not occur, and it turns to be easily treated during cleaning. In addition, the persons who implement the present invention can dispose the soft wires 191 and 192 on the surface or within the garment body 110 through any means according to the actual requirements. Referring to FIG. 1, under the circumstance the connector 140 is electrically connected to the amplifying unit 130, once sensing a sound, the sound receiver 120 transmits an audio signal to the amplifying unit 130 through a plurality of soft wires 192, and then, the amplifying unit 130 amplifies the audio signal, thereby driving the electret speaker 160 electrically connected to the connector 140.

Figure 3:
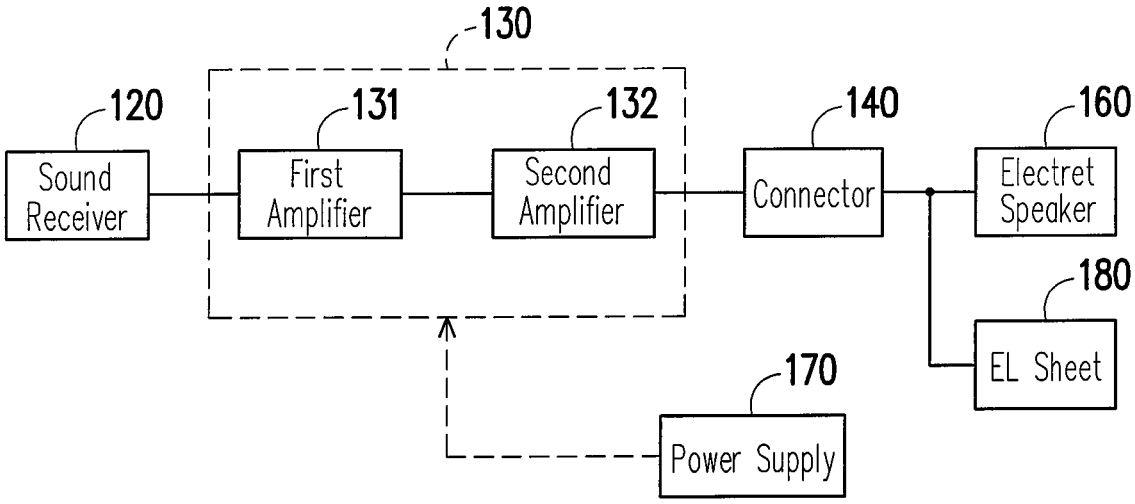
FIG. 3 is a circuit diagram of the garment with the speaker function of FIG. 1.

Furthermore, FIG. 3 is a circuit diagram of the garment with the speaker function of FIG. 1. Referring to FIG. 3, the amplifying unit 130 is electrically connected to the sound receiver 120, the connector 140, and the power supply 170, and the connector 140 is electrically connected to the electret speaker 160 and an electro-luminescent (EL) sheet 180. Here, the power supply 170 provides the power required by the amplifying unit 130 during operation. The amplifying unit 130 includes a first amplifier 131 and a second amplifier 132, in which the first amplifier 131 is electrically connected to the second amplifier 132 and the sound receiver 120, and the second amplifier 132 is electrically connected to the connector 140. After receiving the audio signal output from the sound receiver 120, the first amplifier 131 amplifies the signal, so as to generate an audio voltage, and the voltage scope thereof generally falls between 300 millivolt and 1 volt.

Similarly, after receiving the audio voltage output from the first amplifier 131, the second amplifier 132 performs the amplifying process, so as to generate an audio AC voltage that falls between ±20 volts and ±200 volts, and the second amplifier 132 may be Class A, Class AB, or Class D amplifier. Therefore, the electret speaker 160 operates according to the audio AC voltage received by the connector 140. Here, it should be noted that, the reason why the second amplifier 132 generates the AC voltage lies in that the electret speaker 160 in this embodiment generates the audio signal through the vibration of a conductive vibrating film, and the speaker must receive the AC voltage to make the conductive vibrating film generate positive and negative polarities for vibration, and thus, the electret speaker 160 needs the audio AC voltage generated by the second amplifier 132 for operation.

On the other hand, since the EL sheet 180 requires a quite high operating voltage, and the audio AC voltage generated by the second amplifier 132 just falls within the scope of the operating voltage for the EL sheet 180, the EL sheet 180 is electrically connected to the connector 140. The EL sheet 180 may blink according to the positive and negative conversion of the audio AC voltage.

Figure 4A:
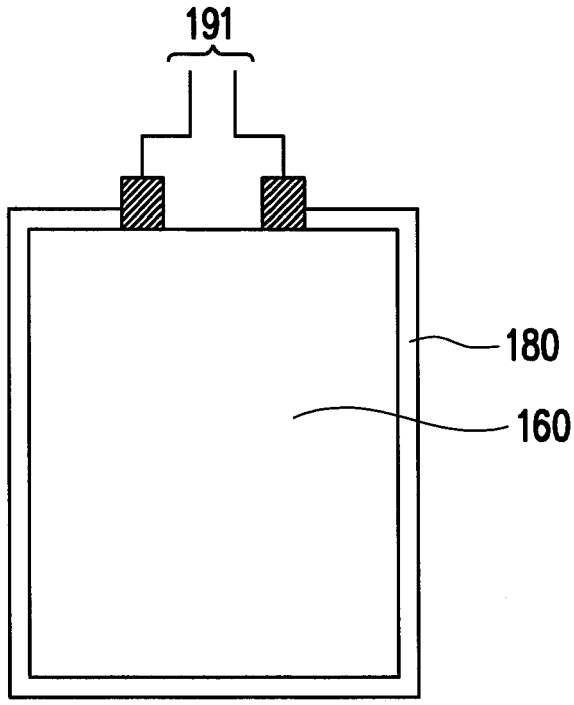
FIG. 4A shows an implementing example of an electret speaker and an electro-luminescent (EL) sheet according to the present invention.

FIG. 4A shows an implementing example of an electret speaker and an electro-luminescent (EL) sheet according to the present invention. In this embodiment, the EL sheet 180 is disposed at a periphery of the electret speaker 160. The EL sheet 180 is connected to the electret speaker 160 in parallel, and then they are coupled to the amplifying unit 130 through the soft wire 191 and the connector 140. Therefore, once the amplifying unit 130 drives the electret speaker 160 to give off the sound, it blinks at the periphery (the EL sheet 180) of the electret speaker 160 as the sound changes.

The EL sheet 180 is not only for the sake of aesthetic sensibility, but also has the function as a warning indicator. For example, at night, the garment 100 having the EL sheet 180 in this embodiment makes the wearer become more noticeable, so as to avoid traffic accidents or other dangers.

In this embodiment, although the EL sheet 180 is disposed around the electret speaker 160, the present invention is not limited here. In other embodiments, those skilled in the art may dispose the EL sheet 180 at other positions according to the actual requirements. In addition, the shape of the EL sheet 180 may also be changed, for example, the EL sheet 180 may be designed into the shape of a small flower, moon, sun, etc. Furthermore, a controller (not shown) for the EL sheet 180 may be additionally disposed, which controls the EL sheet 180 to display different colors by means of determining the voltage magnitude of the audio AC voltage.

Figure 4B:
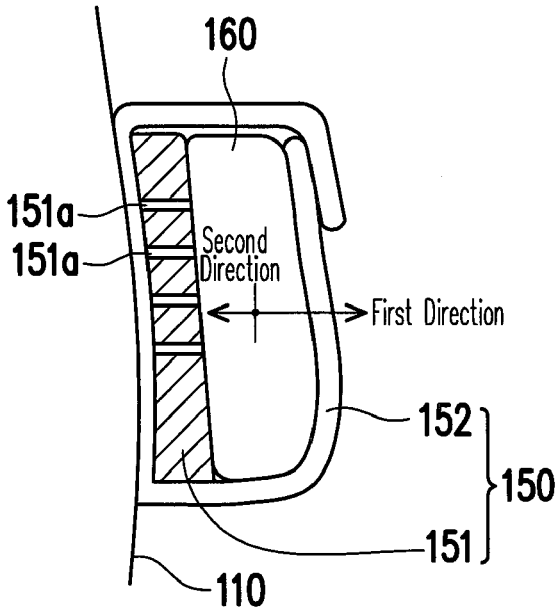
FIG. 4B is a cross-sectional view of a bag disposed on the garment body of FIG. 1.

Here, the disposing manner of the electret speaker 160 is illustrated. FIG. 4B is a cross-sectional view of a bag disposed on the garment body of FIG. 1. In FIG. 4B, the bag 150 includes a sound-absorbing layer 151 and a protective layer 152. The electret speaker 160 is placed between the sound-absorbing layer 151 and the protective layer 152. The electret speaker 160 is a dipole speaker, so it can give off sound reversely on double sides. That is, the electret speaker 160 can give off the sound to a first direction and a second direction at the same time, and the phase of the first direction is reversed to that of the second direction. When the sound of the second direction is reflected upon being blocked by an obstacle, it may be counteracted or added with the sound of the first direction, such that the sound of the first direction is seriously affected.

In the method of the conventional art, this defect is eliminated through changing the position for placing the speaker. However, in this embodiment, the sound-absorbing layer 151 is particularly employed to absorb the sound of the second direction, thereby preventing the sound of the second direction from interfering the sound of the first direction due to being reflected. In addition, the sound-absorbing layer 151 may be further used to prevent the electret speaker 160 from directly contacting the body of the wearer to result in an insufficient vibration space for the electret speaker 160 and thus further affecting the speaker quality.

The persons who implement the present invention can determine the sound absorption coefficient, material, and thickness of the sound-absorbing layer 151 according to the actual requirements. In this embodiment, the sound-absorbing layer 151 made of a sound absorbing material with the sound absorption coefficient of larger than 0.3 or 0.5 may be used. The sound-absorbing layer 151 may be made of a porous material, for example, fiber material or foam material. As shown in FIG. 4B, the sound-absorbing layer 151 includes a plurality of pores 151*a*. As the thickness of the sound-absorbing layer 151 increases, the sound absorbing effect is also increased. However, in order to make the wearer feel more comfortable when wearing the garment, the sound-absorbing layer 151 in this embodiment is made of a sound absorbing material with a thickness between 0.1 millimeters and 5 millimeters. In this manner, not only the wearer feels more comfortable, but the sound quality of the electret speaker160 is also improved. In this embodiment, the sound absorption coefficient, material, and thickness of the sound-absorbing layer 151 is only one alternative embodiment, and the present invention is not limited here.

The protective layer 152 is used to protect the electret speaker 160. The persons who implement the present invention can select a water-proofing and air-permeable cloth to form the protective layer 152. In addition, it should be noted that, when the connector 140 is connected to an external device, the garment 100 with the speaker function is further operated according to the signal output from the external device. For example, when the connector 140 is connected to a walkman, the garment 100 with the speaker function is turned to serve as a music player, and the wearer can enjoy the music while doing exercises, so as to enjoy the fun at anytime anywhere.

It should be noted that, when the garment 100 with the speaker function is turned into a music player, the EL sheet 180 achieves more distinctive effects. When the wearer listens to the music, it is not easy for him/her to perceive the environmental sounds, so the EL sheet 180 can inform others through the visual effect that the wearer is enjoying music, such that the wearer is more easily noticed, thereby avoiding traffic accidents and other dangers.

Figure 5:
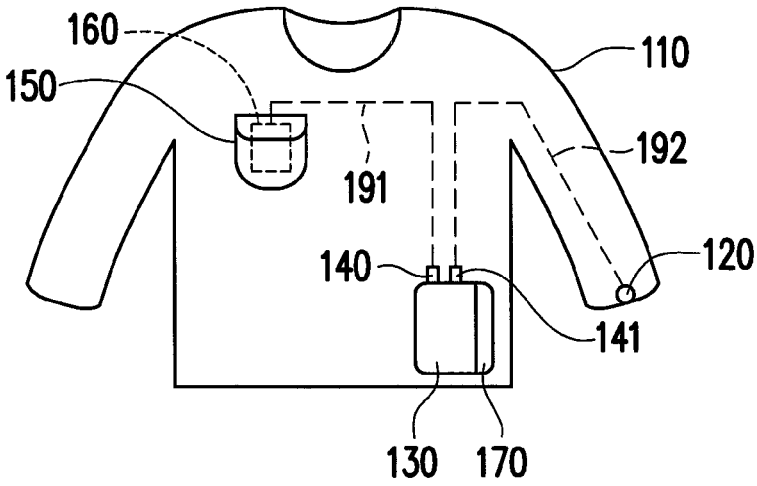
FIG. 5 shows another configuration manner of the garment with the speaker function according to the embodiment of the present invention.

FIG. 5 shows another configuration manner of the garment with the speaker function according to the embodiment of the present invention. Besides being disposed at the collar of the garment body 110 as shown in FIG. 1, the sound receiver 120 may also be disposed at the cuff as shown in FIG. 5, so that the wearer can receive the sounds randomly by putting the hand at the position where the sound receiver 120 is located, which is much more convenient. In addition, in FIG. 5, the amplifying unit 130 is disposed at the waist and abdomen part of the garment body 110, the bag 150 is disposed at the chest part, and the power supply 170 is also disposed at the waist and abdomen part. However, the amplifying unit 130 may be further disposed at the chest part of the garment body 110; the bag 150 may be disposed at the back (disposed at the chest and back part is suitable for a tourist guide when touring around), at the shoulder (suitable for individuals to enjoy music), or at the waist as shown in FIG. 1; and the power supply 170 may also be hung at the waist of the wearer. As for the disposing manner of the above elements, fixed disposing positions do not exist, and the disposing positions can be determined depending upon the actual using requirements, which is not limited to the above mentioned.

Figure 6:
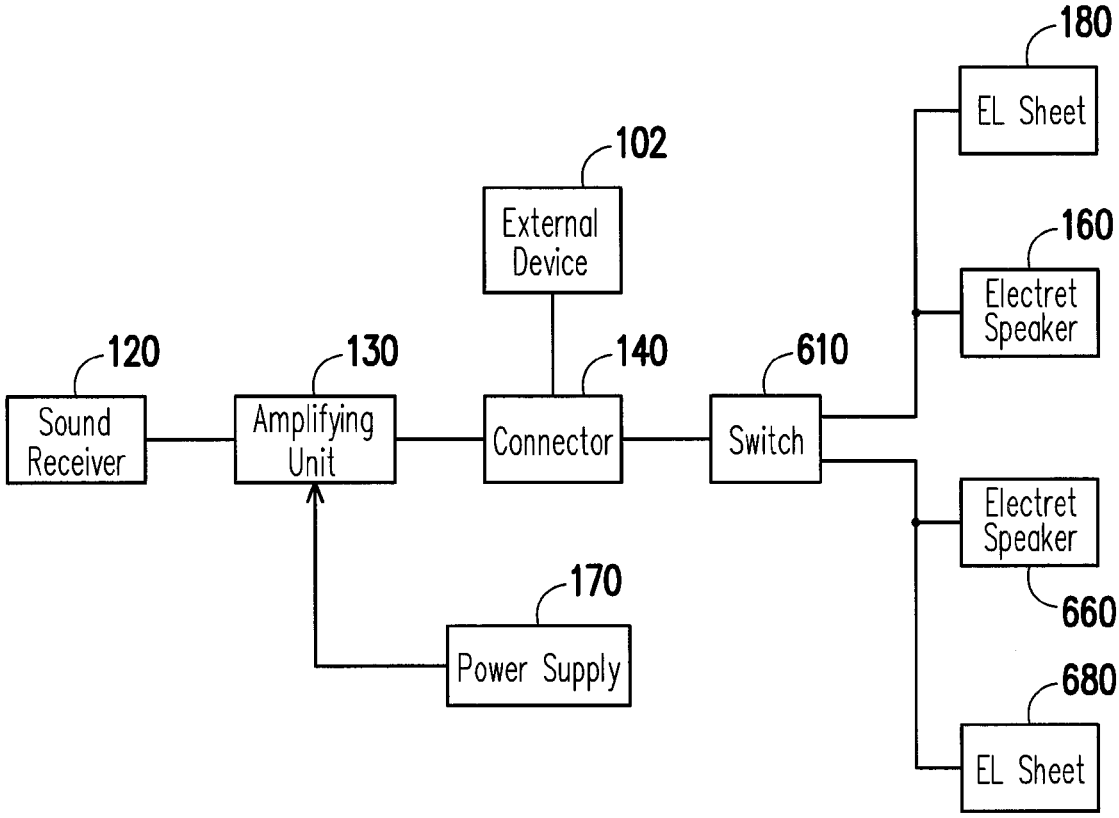
FIG. 6 is another circuit diagram of an embodiment of the present invention.

It should be noted that, the garment 100 with the speaker function in the above embodiment is not limited to being connected to an electret speaker, and the implementing manner is shown in FIG. 6. In FIG. 6, the coupling manner for each element is similar to that of the above embodiment, but a switch 610, an electret speaker 660, and an EL sheet 680 are further added. The switch 610 is used to switch the motions of the electret speakers 160 and 660. That is to say, according to the switching manner of the switch 610, the electret speakers 160 and 660 may operate individually or operate together. In other embodiment, when the connector 140 is connected to a external device 102, the electret speaker 160 or 660 is operated according to a signal output from the external device 102. Therefore, the connecting mode shown in FIG. 6 has rendered more diversified using manners for the wearer to select.

In addition, with reference to the teachings of the above embodiment, those skilled in the art can use soft wires to electrically connect the elements, and the soft wires may be knitted in the fabric of the garment body 110 in FIG. 5.

Figure 7:
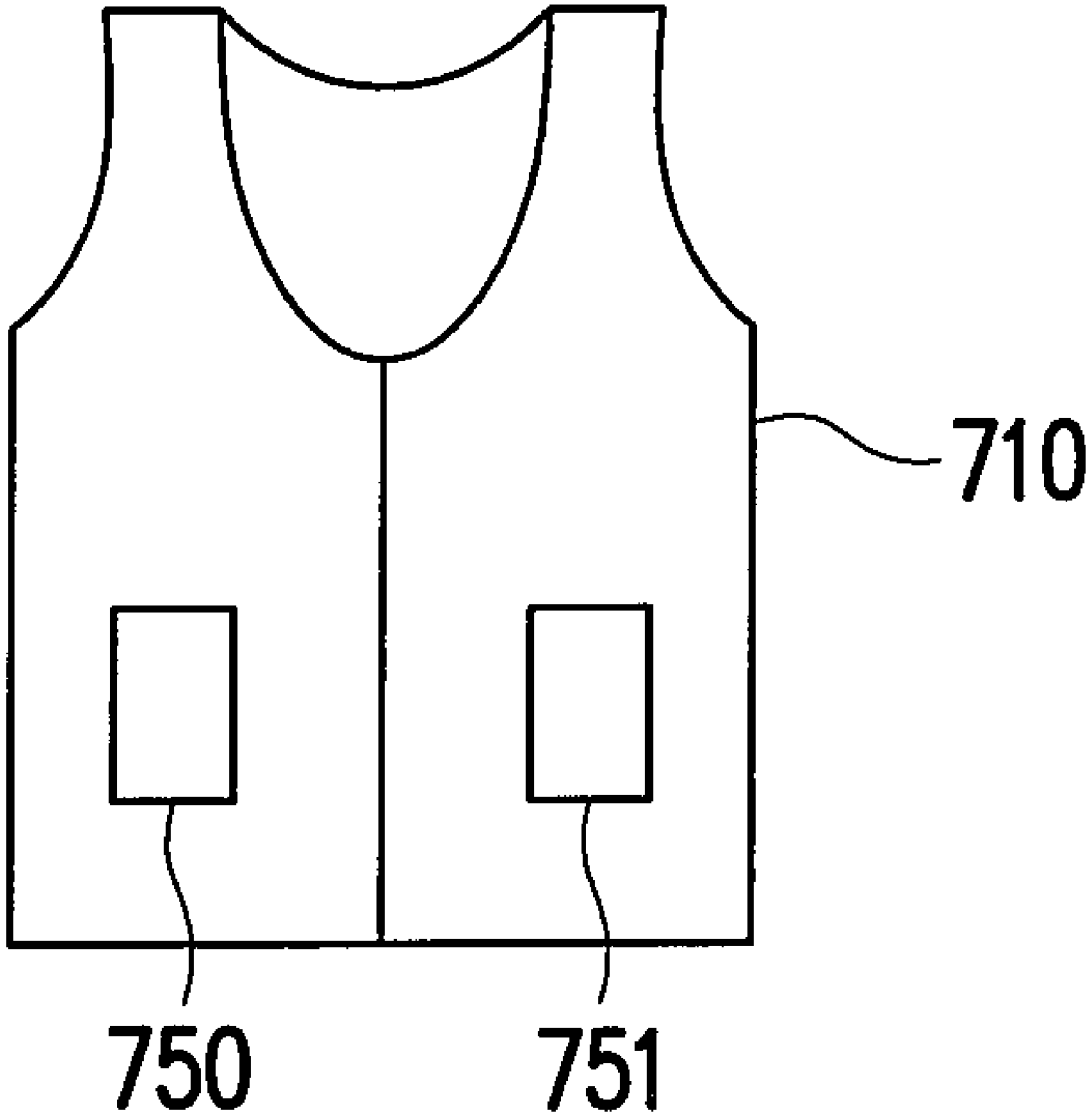
FIG. 7 shows another style of a garment with a speaker function according to an embodiment of the present invention.

Furthermore, the style and design of the garment body 110 in the above embodiment are not limited to the style shown in FIG. 1, but may be the style and design of a common garment available on the market, which is not limited here. FIG. 7 shows another style of a garment with a speaker function according to an embodiment of the present invention. As known from FIG. 7 that, the garment body 710 is a vest with two bags 750 and 751 disposed thereon, and this style design can be matched with the circuit for connecting two electret speakers. Therefore, it can be known from the above descriptions that, the garment with the speaker function of the present invention is not limited to a bag and a speaker, but can be derived in the same way according to the descriptions with reference to the accompanying drawings, as long as the disposing manner thereof does not depart from the spirit of the present invention.

To sum up, in the present invention, the electret speaker is disposed on the garment, and the sound-absorbing layer is further used for absorbing the sound of a specific direction, so as to enhance the acoustic quality. Therefore, the present invention can not only solve the problem of the conventional art in terms of the convenience, but also improve the acoustic quality of the electret speaker. In addition, the embodiments of the present invention at least have the following advantages.

1. The present invention enables the speaker function to be used by the user in assisting work or enjoying the fun, while the user wears the garment for decoration and keeping warm, so it is not necessary to worry that the megaphone must be hold with hand or the portable loudspeaker may be thrown out.

2. The speaker function can also be used to deliver message or play music, while the user is jogging or doing exercises, so it is not necessary to worry that the problem of the conventional art may limit the motions of the user.

3. The plurality of soft wires for connecting the elements is knitted in the fabric, so the wires are not exposed out of the garment, which can be easily treated during cleaning.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A garment with a speaker function, comprising:

a garment body;

a bag, comprising a sound-absorbing layer, and disposed on the garment body;

an electret speaker, disposed in the bag, and giving off sounds to a first direction and a second direction at the same time, wherein the sound-absorbing layer is used to absorb the sound of the second direction;

a connector, disposed on the garment body, and electrically connected to the electret speaker;

a sound receiver, for sensing a sound to output an audio signal;

an amplifying unit, electrically connected to the sound receiver and the connector, for amplifying the audio signal and driving the electret speaker;

a power supply, electrically connected to the amplifying unit, for providing power required by the amplifying unit during operation; and an electro-luminescent (EL) sheet, electrically connected to the connector, disposed on the garment body, and emitting lights according to a motion of the electret speaker, wherein the connector is electrically connected to the electret speaker, the amplifying unit, and the EL sheet through a first soft wire, a second soft wire, and a third soft wire respectively, and the amplifying unit is electrically connected to the sound receiver through a fourth soft wire and a fifth soft wire respectively, and the first soft wire, the second soft wire, the third soft wire, the fourth soft wire, or the fifth soft wire is knitted in fabric of the garment body.

2. The garment with a speaker function according to claim 1, wherein the amplifying unit comprises:

a first amplifier, electrically connected to the sound receiver, for amplifying the audio signal to output an audio voltage; and a second amplifier, electrically connected to the first amplifier and the connector, for generating an audio alternating current (AC) voltage according to the audio voltage, so as to drive the electret speaker.

3. The garment with a speaker function according to claim 2, wherein the second amplifier is a Class A amplifier, Class AB amplifier, or Class D amplifier.

4. The garment with a speaker function according to claim 1, wherein the power supply is disposed on the garment body or at a waist of a wearer.

5. The garment with a speaker function according to claim 1, wherein when the connector is connected to an external device, the electret speaker is operated according to a signal output from the external device.

6. The garment with a speaker function according to claim 1, wherein the sound receiver is disposed at a collar or cuff of the garment body.

7. The garment with a speaker function according to claim 1, wherein the amplifying unit is disposed on the chest or abdomen part of the garment body.

8. The garment with a speaker function according to claim 1, wherein the bag further comprises:

a protective layer;

wherein the electret speaker is disposed between the sound-absorbing layer and the protective layer.

9. The garment with a speaker function according to claim 8, wherein the protective layer is made of a water-proofing and air-permeable cloth.

10. The garment with a speaker function according to claim 1, wherein the bag is disposed on the chest, abdomen, back, or shoulder part of the garment body.

11. The garment with a speaker function according to claim 1, wherein a thickness of the sound-absorbing layer is between 0.1 millimeters and 5 millimeters.

12. The garment with a speaker function according to claim 1, wherein a sound absorption coefficient of the sound-absorbing layer is larger than 0.3.

13. The garment with a speaker function according to claim 1, wherein the sound-absorbing layer comprises a plurality of pores.

14. The garment with a speaker function according to claim 1, wherein the sound-absorbing layer is made of a fibre material or a foam material.

15. The garment with a speaker function according to claim 1, wherein the first direction and the second direction are opposite to each other.

* * * * *